US006085363A

United States Patent [19]

Huber

[11] Patent Number: 6,085,363

[45] Date of Patent: Jul. 11, 2000

[54] WATER CLOSET FITTING WITH TEST BAFFLE

[76] Inventor: Donald G. Huber, P.O. Box 64160, Tacoma, Wash. 98464

[21] Appl. No.: 09/350,820

[22] Filed: Jul. 9, 1999

Related U.S. Application Data

[60] Provisional application No. 60/092,313, Jul. 9, 1998.

[51] Int. Cl.[7] ..... E03D 11/16; E03D 11/17

[52] U.S. Cl. ..... 4/252.4; 4/252.1; 138/90; 285/24

[58] Field of Search ..... 4/252.1–252.6; 285/24, 27, 45; 138/90, 92, 94, 94.5, 96 R, 110; 137/68.19; 52/95, 96, 82

[56] References Cited

U.S. PATENT DOCUMENTS

| | | | |
|---|---|---|---|
| 1,720,819 | 7/1929 | Cohen | 138/90 |
| 1,948,220 | 2/1934 | Kennedy | 182/7 |
| 2,596,182 | 5/1952 | Sosaya | 285/33 |
| 3,132,685 | 5/1964 | McKinnon | 158/46.5 |
| 3,319,268 | 5/1967 | Blumenkranz | 4/252 |
| 3,392,409 | 7/1968 | Politz | 4/199 |
| 3,775,780 | 12/1973 | McEwen | 2/252 R |
| 3,952,340 | 4/1976 | Cuschera | 4/252 R |
| 4,142,371 | 3/1979 | Mayfield et al. | 405/224 |
| 4,194,252 | 3/1980 | Tsuei | 4/199 |
| 4,406,480 | 9/1983 | Izzi | 285/12 |
| 4,423,526 | 1/1984 | Izzi, Sr. | 4/252 R |
| 4,429,568 | 2/1984 | Sullivan | 73/49.8 |
| 4,460,019 | 7/1984 | Condon | 138/90 |
| 4,542,642 | 9/1985 | Tagliarino | 73/40.5 R |
| 4,602,504 | 7/1986 | Barber | 73/49.8 |
| 4,658,861 | 4/1987 | Roberson, Sr. | 138/90 |
| 4,669,131 | 6/1987 | Barlow | 4/198 |
| 4,706,482 | 11/1987 | Barber | 73/49.8 |
| 4,780,915 | 11/1988 | Cuschera | 4/252 R |
| 4,823,411 | 4/1989 | Nettel | 4/255 |
| 4,827,539 | 5/1989 | Kiziah | 4/252 R |
| 4,873,730 | 10/1989 | Cuschera | 4/252 R |
| 4,936,350 | 6/1990 | Huber | 138/90 |
| 5,033,510 | 7/1991 | Huber | 138/90 |
| 5,099,887 | 3/1992 | Hooper | 138/89 |
| 5,115,554 | 5/1992 | Fell, Sr. | 4/252.4 |
| 5,377,361 | 1/1995 | Piskula | 4/252.4 |
| 5,623,971 | 4/1997 | Foernzler | 138/89 |

*Primary Examiner*—David J. Walczak
*Assistant Examiner*—Tuan Nguyen
*Attorney, Agent, or Firm*—Garrison & Associates PS; David L. Garrison

[57] ABSTRACT

A water closet fitting comprising a removable test baffle allows a water closet drain system to be tested for fluid tight integrity after the fitting has been installed in a poured, permanently set floor such as concrete. The test baffle is removably attached to the fitting, preferably by interfering fit between the test baffle and the fitting, for efficient installation, and comprises means for removing the baffle entirely from the fitting and the drain system after the completed system has been permanently installed and successfully tested. A preferred embodiment of the baffle is flexible, has a diameter greater than that of the central drain system, and comprises a central dome to enhance its pressure resistant characteristics. The flexibility of the baffle allows it to be removed through the installed drain system after the system has been tested successfully.

11 Claims, 4 Drawing Sheets

WATER CLOSET FITTING WITH TEST BAFFLE

This application claims the benefit of U.S. provisional patent application Ser. No. 60/092,313, entitled Water Closet Fitting with Test Baffle and filed Jul. 9, 1998.

TECHNICAL FIELD

The invention relates to method and apparatus for testing drain systems for water closets set in permanent flooring. More particularly, it relates to method and apparatus for pressure testing of water closet drain systems by means of test baffles removably attached to water closet fittings.

BACKGROUND OF THE INVENTION

In building construction, a newly installed or repaired operating sewage conduit in the building waste or sewer drainage system must frequently be isolated from the sewage service line until the plumbing construction is tested and inspected by subjecting the system to a fluid pressure test to locate any leaks, and certified for compliance with building code requirements. This is especially true in the case of water closet drains. It is common practice within the construction industry to place an outlet end of a newly installed sewage conduit of the building at a juncture near an inlet to a sewage service line. During installation, these two lines are capped and not connected. Where these two lines would otherwise meet, each line is capped off until testing and inspection are complete. As a result of usual construction techniques, the juncture is frequently buried before the tests are performed. After the testing and inspection are complete, the connection site is re-excavated, the caps removed, and a secure connection of the two lines is made. The difficulty of making such tests is often aggravated by the fact that at another end of the system a water closet is often installed in a poured, permanent floor, such as concrete. Once the water closet fitting and drain have been installed and allowed to set, it is generally either exceedingly difficult or impossible to access the drain fitting. Thus a vexing question has been posed by the need to seal the drain system to accommodate testing.

Various patents have been issued disclosing test or isolation valve assemblies used in the inspection of drain systems prior to connection of the systems to sewer lines.

Sullivan U.S. Pat. No. 4,429,568, discloses a closure plug for pressure testing a liquid drain and vent plumbing type system. Sullivan uses a clean-out Y for access to open the plug plate assembly.

Cohen U.S. Pat. No. 1,720,819, discloses a test tee having a tapered gate which closes off a house drain pipe from a drainage system. After the test has been completed, the gate is removed from the test tee and the resulting opening in the tee is closed by a cover plate.

Tagliarnio U.S. Pat. No. 4,542,642, discloses a test tee having a plug which is a removable blocking disk. The blocking disk engages a ledge in the test tee and seals the drainage system. The diaphragm is accessible and removable through an access means.

Roberson U.S. Pat. No. 4,658,861, discloses a pneumatic plug inserted through a clean-out tee to block off a house service line to the main sewer line.

Kennedy U.S. Pat. No. 1,948,220, discloses a test plumbing system using a flap valve which is pivoted at an upper side of the valve seat. The flap valve is held in position by a valve adjusting rod.

Barber U.S. Pat. No. 4,602,504, shows a permanently installed test fitting in which a seal diagram has a frangible, removable portion which may be broken away from the diaphragm and removed to permit service use of the system. A portion of the seal diaphragm remains permanently in the conduit with its edge exposed.

These references relate to the general field of disclosure of this invention but many suffer from the permanent presence of apparatus in the conduit which can catch refuse and cause pluggage.

More recently, U.S. Pat. Nos. 4,848,155, 4,936,350, 5,033,510, and 5,163,480 to Huber have disclosed various apparatus for isolating and testing plumbing installations.

None of the above references teaches methods or apparatus adapted for use in water closet or other fitting installations made in poured, permanently set floors, where access to the fittings and to the test or isolation apparatus is impractical or impossible once the fitting has been installed. Nor do any of the references teach or suggest means for isolating a water closet drain system by means of an apparatus which allows selective rotational setting of the water closet stool after the water closet drain has been installed in a permanently set floor. This latter ability is highly advantageous in most construction situations, where minor nuances in alignment and spacing can be critical, particularly in the close, starkly decorated environment typical of water closets.

Thus there exists a need for a water closet fitting adapted for the facilitation of the testing of water closet drain systems, without danger of permanently fouling or obstructing the drain system, and which is easy and convenient to install in poured, permanently set flooring in which access to the fitting and to the drain system will be restricted or prevented. There is a further need for such a system which allows a water closet stool to be set in a selectable rotational position with respect to the installed drain system and the permanent floor in which the drain system is set.

DISCLOSURE OF THE INVENTION

Accordingly, it is an object of the invention to provide a water closet fitting adapted for the accommodation of the testing of water closet drain systems, without danger of permanently fouling or obstructing the drain system, and which is easy and convenient to install and operate in poured, permanently set flooring in which access to the fitting and to the drain system will be restricted or prevented, and in which dismantling of the drain system to perform the test is impractical or impracticable. It is a further object to accomplish the foregoing while allowing mounting of a water closet stool on the drain system in a selectable rotational position with respect to the installed drain system and the permanent floor in which the drain system is set.

It is a particular object of the invention to provide such a water closet fitting which comprises a test baffle removably attached to the fitting in order to facilitate the easy and convenient attachment of the water closet fitting to the water closet drain system.

It is a general object of the invention to provide a secure but removable closure means for a vent and wastewater drainage system for a water closet which may be used for isolation and testing purposes.

A further object of the invention is to provide a test or isolation baffle which may be held in position on the drain side of the water closet fitting between the water closet fitting and the water closet drain system until the test has been completed, and then conveniently removed.

Another object is to provide a flexible, preferably domed, test or isolation baffle which has sufficient strength and resilience to resist the hydraulic test pressure applied to the water closet drain system, but which also may be easily removed through a drain system having an interior diameter smaller than the outside diameter of the test baffle.

These and such other objects of the invention as will become evident from the disclosure are met by the invention described herein. The invention provides a water closet fitting comprising a removable test baffle which allows a water closet drain system to be tested for fluid tight integrity after the fitting has been installed in a poured, permanently set floor such as concrete. The test baffle is removably attached to the fitting, preferably by interfering fit between the test baffle and the fitting, for efficient installation, and comprises means for removing the baffle entirely from the fitting and the drain system after the completed system has been permanently installed and successfully tested. Preferred embodiments of the baffle are flexible, have diameters greater than that of the central drain system, and comprise a central dome to enhance their ability to resist pressure. The flexibility of the baffle allows it to be removed through the installed drain system after the system has been tested successfully.

An apparatus aspect of the invention provides a water closet fitting and test baffle assembly for installation within and pressure testing of a water closet drain system in a poured, permanently set floor. The assembly comprises a water closet fitting, a flange which is optionally part of the water closet fitting, and a test baffle.

The water closet fitting comprises a first end, a second end, and an interior surface. The first end is adapted for engagement of a drain system, such as a building plumbing drain, having an inside diameter and an interior surface. The first end of the fitting, which as such fittings are typically installed is generally the lower end, comprises an adjacent interior seat recessed or circumferentially recessed into or otherwise disposed in the interior surface of the fitting to receive the test baffle in a fluid tight sealing relationship. The seat typically has a diameter greater than the inside diameter of the fitting. The second end of the fitting, which is typically the upper end proximate to which the water closet or toilet stool is generally installed, is adapted to engage, or is integrally connected to, the flange.

The flange is adapted to engage a water closet stool in a selectably permanent and/or releasable or adjustable engagement. Typically the flange constitutes either a separate piece disposed around the second or generally upper end of the water closet fitting, or an integral part of the second end. Generally it comprises holes or slots (circumferentially elongated holes) which can be used to mechanically fasten, by means of for example bolts, the toilet seat to the water closet fitting and therefore indirectly to the floor. The use of appropriate mechanical fasteners such as bolts or other releasable or removable fasteners, as will be readily understood by those familiar with the art of installing water closets, allows the stool to be releasably or adjustably attached to the water closet fitting and the floor. In embodiments of the invention in which the water closet fitting and the flange comprise distinct parts, the flange typically forms a freely rotating ring around the upper end of the fitting. This is preferably arranged by adapting an inner circumferential surface of said flange for rotatable engagement of an outer circumferential surface of the second end of the fitting, whereby the flange may be selectably positioned to engage a water closet stool in a desired rotational orientation relative to the fitting. Such an arrangement permits the stool to be attached to the fitting with unlimited freedom in rotational placement. When the fitting and the flange form a single integral part, the use of slots in the flange for accommodating the stool fasteners allows the stool to be placed with a typically somewhat smaller degree of rotational freedom. In any case, attachment of the stool to the flange typically restrains the stool from vertical displacements, and keeps the stool in place for proper drainage through the drain system.

The test baffle is adapted to be received in the interior seat in the water closet fitting, and typically comprises a central web comprising a convex central dome and a means for removing the baffle after the drain system has been tested. While it is generally preferred that web of the baffle comprise a convex central dome, it is in some instances preferable to employ a flat web for the baffle instead. For example, it can be more economical to manufacture baffles comprising a flat web than a convex dome; and flat configurations may produce completely satisfactory results, particularly at relatively low test pressures. The baffle is generally flexible and has an unflexed diameter exceeding the inside diameter of the fitting, and typically that of the seat as well. By activating the removal means the flexible baffle may then be removed from the drain system by way of the drain system, leaving behind no permanent structure or other material or portion of the baffle to obstruct or interfere with flow within the drain. Preferred embodiments of the test baffle comprise means for releasable interengagement of the baffle by the seat. Most preferably, such means comprise the provision of the baffle and the first (typically lower) end of the water closet fitting, preferably along the interior seat provided for the baffle, with a dependent member and a receiving member, with the dependent member being adapted for interfering or "snap" fit within the receiving member. Among other advantages, this allows the water closet fitting, with test baffle attached, to be installed easily, since as the fitting is placed into its installed position, with its first end in the typically down position, the test baffle stays in place while the water closet fitting is fitted to the drain system without need for holding the baffle in place by separate means and without the baffle being dislocated and interfering with the installation. Optional means for removably attaching the test baffle to the water closet fitting comprise integrally forming the test baffle with the first end of the fitting, and providing the test baffle at its junction with the fitting with a score line adjacent to said its seat in the first end, and a means for removing the test baffle by breaching the seal along the score line holding the baffle to the fitting. Optionally the test baffle further comprises a membrane for retaining the removal means proximate the baffle web, as for example during shipping, transportation, handling, or installment, the membrane being removable upon installation to release the removal means for use.

BEST MODE OF CARRYING OUT THE INVENTION

Turning now to the drawings, there are seen in FIGS. 1–12 various embodiments of the apparatus aspect of the invention.

Figure 1:
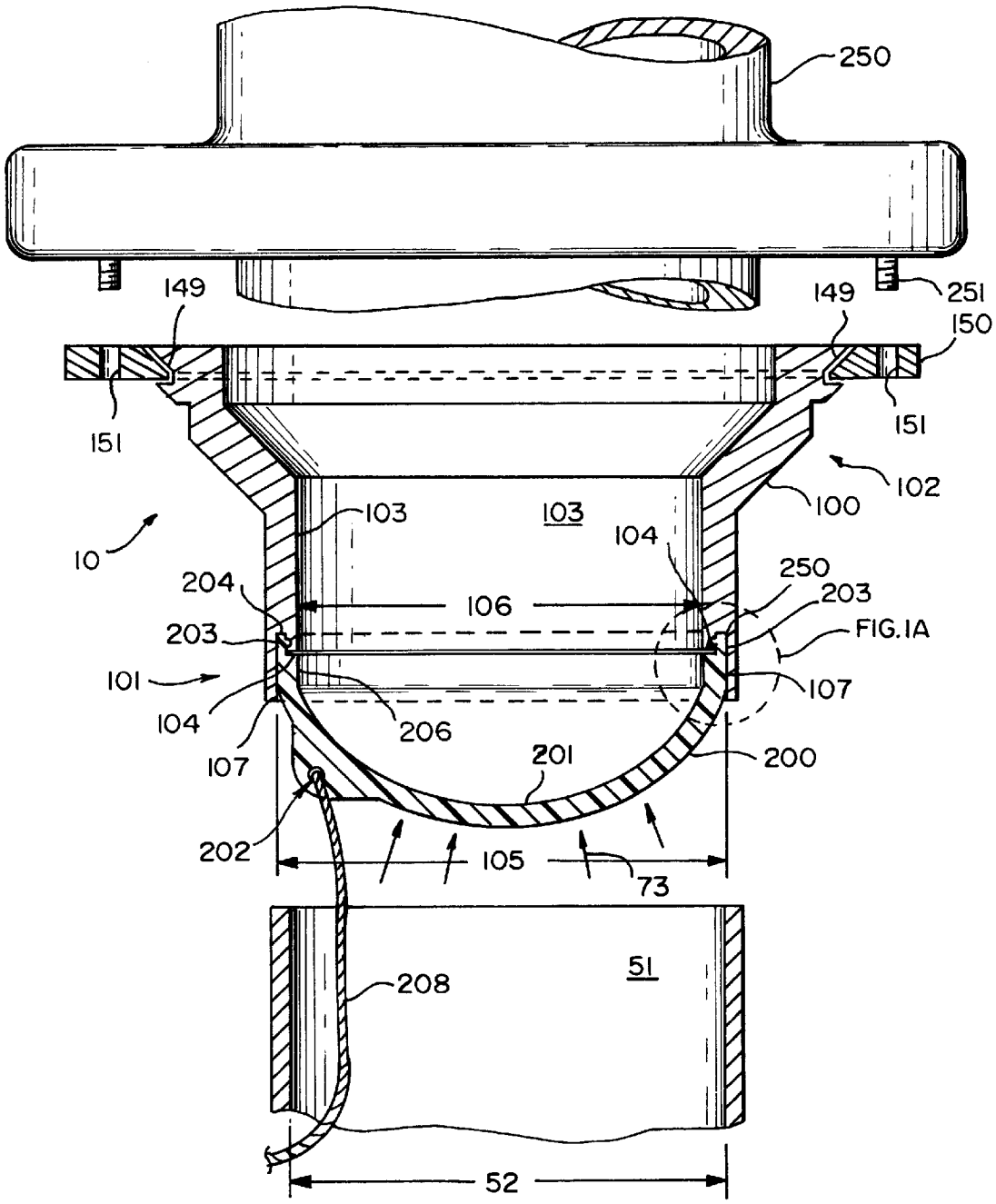
FIG. 1 is a schematic cutaway view of a preferred embodiment of a water closet fitting and test baffle according to the invention.

FIG. 1 is a schematic cutaway view of a preferred embodiment of a water closet fitting and test baffle according to the invention. Water closet fitting and test baffle apparatus 10 comprises water closet fitting 100, flange 150, and test baffle 200. Water closet fitting 100 comprises first end 101, second end 102, and interior surface 103. First end 101 is adapted for engagement of drain system 50, which comprises pipe or conduit 53, which further comprises inside diameter 52 and interior surface 51. First end 101 of fitting 100, which is shown in the Figure as the lower end of the fitting, comprises interior seat 104, which is circumferentially disposed or recessed into interior surface 103 of fitting 100 to receive test baffle 200 in a fluid tight sealing relationship. Seat 104 has a diameter 105 which is greater than inside diameter 106 of the fitting. Second end 102 of the fitting, which is shown in its typical position as the upper end, is adapted to engage flange 150 by means of annular channel 149. It does not matter, for the purposes of the invention described herein, whether the engagement means for attaching flange 150 to fitting 100, such as annular channel 149, is provided as shown in the water closet fitting or in the flange instead; reversing the channel to the sense opposite that shown in the Figure would have the same effect: annular channel 149 restricts flange 150 from substantial axial displacements with respect to fitting 100 (in the vertical direction as the fitting is shown in the Figure) and laterally as well (in the horizontal direction as shown), but at the same time the channel allows the flange to rotate freely about the water closet fitting. Rotation of flange 150 about the water closet fitting facilitates selective rotational positioning of a water closet stool on the water closet fitting, as for example to align the stool in conformance with the walls or layout or floor plan of a bathroom. Seat 104 may be formed by conventional molding or casting techniques in the water closet fitting, but may also be machined or otherwise formed. For example, an interior circumferential groove may be cut into the interior wall of the fitting. Any means of providing the type of relief within the inner surface of the fitting shown in or suggested by the Figures will suffice.

Flange 150 is adapted to engage water closet stool 250 in a selectably permanent and/or releasable engagement by means of bolts or other fasteners. In the embodiment shown, bolts or machine screws 251 are provided on stool 250 to engage optional threaded fastener holes 151 in flange 150 and/or nuts or other suitable fastener means. In alternative embodiments of the water closet fitting flange 150 is an integral extension of second end 102 of fitting 100.

Figure 1A:
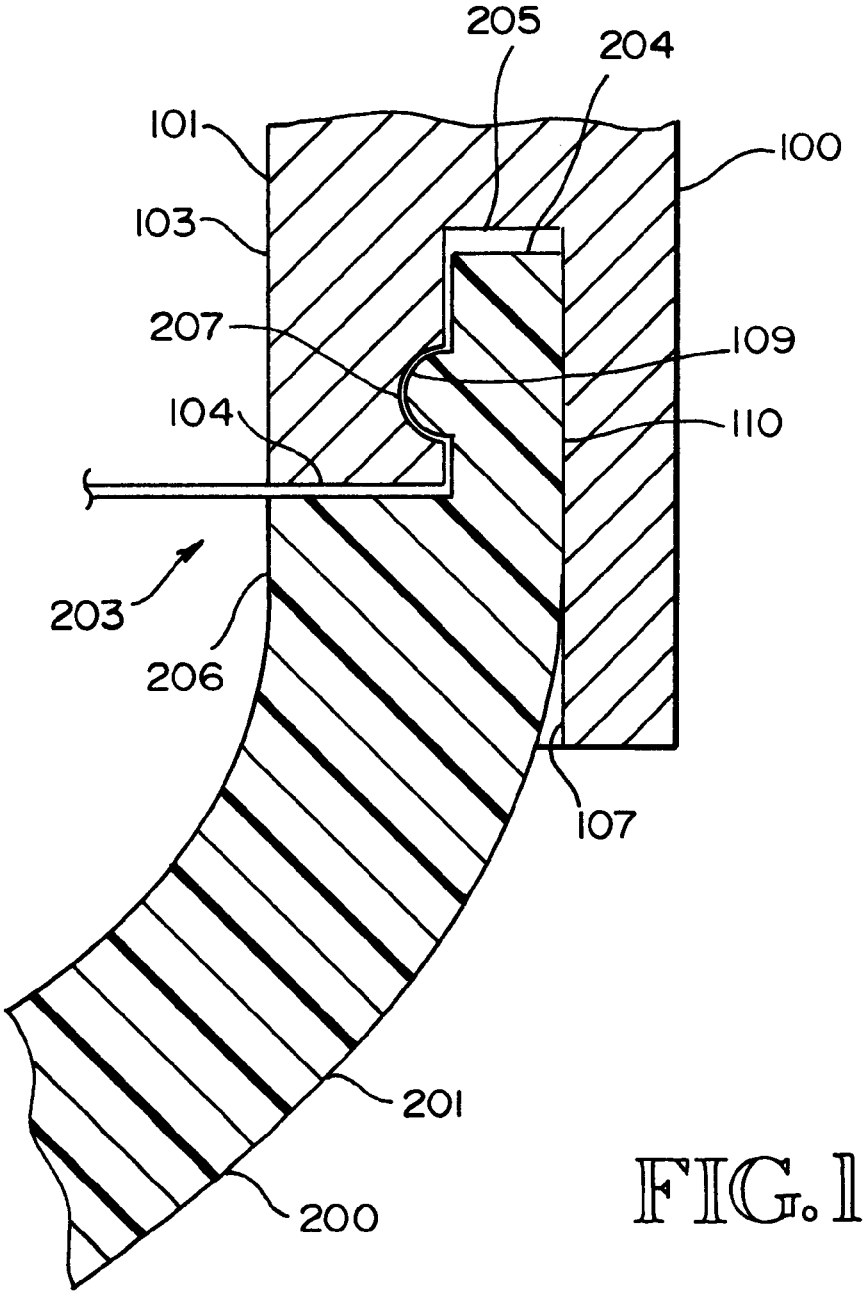
FIG. 1*a* is a partial schematic sectional view of an alternative preferred embodiment of a water closet fitting and test baffle according to the invention, showing that portion of the fitting and baffle which would appear at detail 1*a* in FIG. 1.
Figure 2:
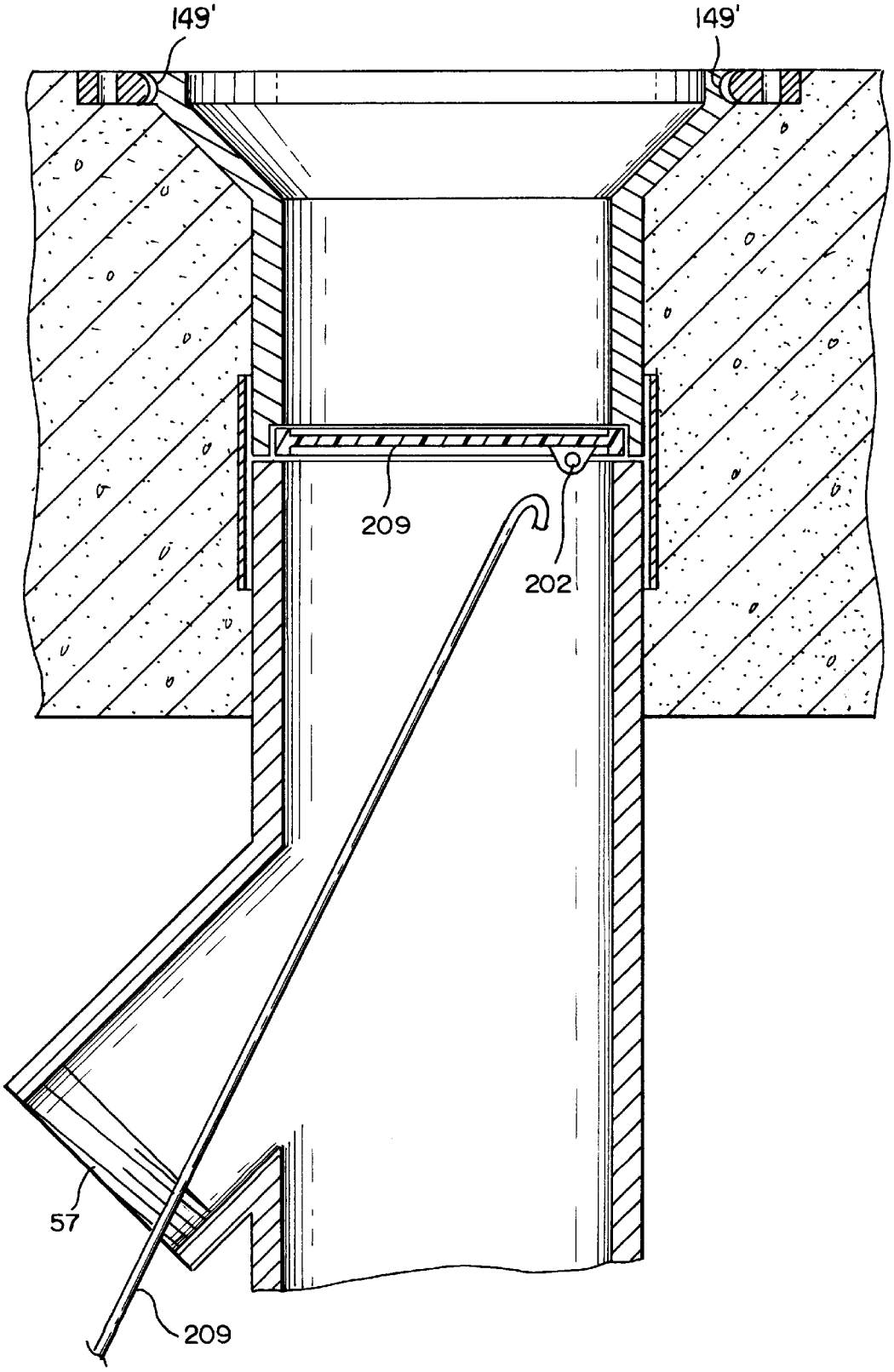
FIG. 2 is a schematic cutaway view of an installed alternative preferred embodiment of a water closet fitting and test baffle according to the invention.
Figure 3:
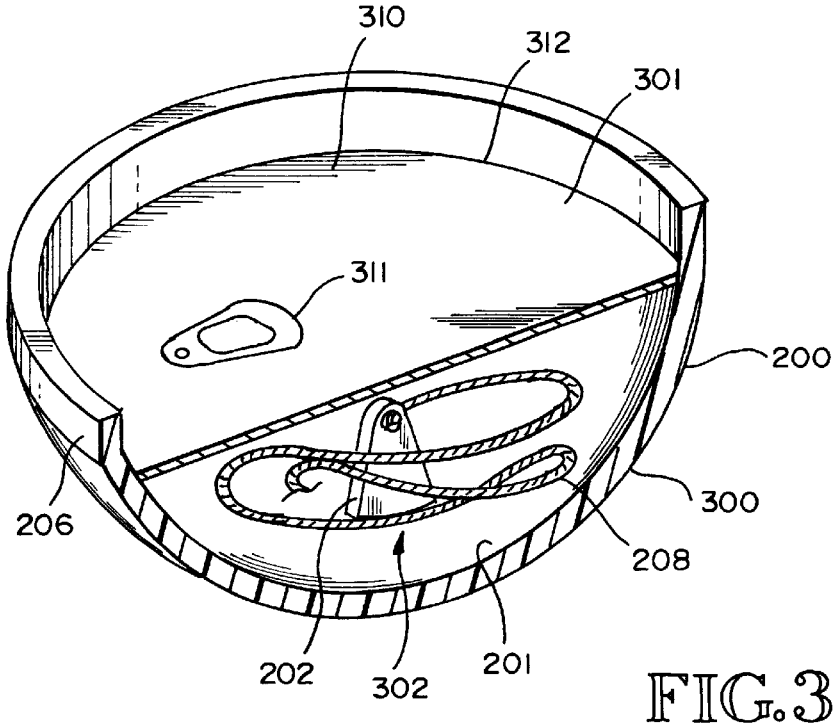
FIG. 3 is a schematic partial cutaway view of a test baffle according to the invention.

Flexible test baffle 200 comprises integral gasket 206, which has an unflexed diameter greater than that of inside diameter 105 of seat 104 of the first end of the water closet fitting and is therefore sized to be received, upon flexure of the baffle, in an interfering fit by gasket wall 107 of seat 104, and thus to provide a fluid-tight seal between baffle 200 and water closet fitting 100, whereby pressure testing of the drain system may be accommodated. In the embodiment shown, test baffle 200 further comprises optional dependent member or rim 204, which is adapted for releasable interfering fit with receiving member or channel 205 in seat 104, preferably adjacent to gasket wall 107. By providing dependent member 204 and channel 205 with a raised radial ridge and a mating radial indentation such as radial ridge 109 and indentation 207 shown in FIG. 1*a*, which is an expanded partial section of an alternative embodiment to that shown in FIG. 1, it is possible to conveniently and economically provide a "snap fit" between baffle 200 and seat 104, thus providing the attachment of the test baffle to the water closet fitting with greater security and an improved fluid tight integrity. Among other advantages, this allows the water closet fitting, with test baffle attached, to be easily installed, since as the fitting is placed into its installed position, with its first end in the typically down position, the test baffle stays in place while the water closet fitting is fitted to the drain system, without need for holding the baffle in place by separate means and without the baffle being dislocated and interfering with the installation. Test baffle 200 further comprises central web 201, which in the embodiment shown comprises convex dome 300 which enhances the pressure-resistant properties of the baffle. As shown in the Figure, dome 300 is oriented to most advantageously resist pressure within drainage system when the drainage system is tested. In the embodiment shown, dome 201 is substantially spherical in shape. In many cases, the dome may advantageously be given a shape which is conical or stepped in the manner of a terrace or a Fresnel lens; or the central web may even be left flat, like central web 209 in FIG. 2. Regardless of shape, the dome is of sufficient concavity (even when flat) and strength to resist test loads commonly induced in the drain system in which it is installed during testing, without buckling, collapsing, or otherwise failing. Integral gasket 206 aids baffle 200 in forming a fluid tight seal within the system. When the convex said of the baffle is subjected to a pressure in the sense indicated by arrows 73 in FIG. 1, the pressure is resisted by compression and relatively minor amounts of bending within the dome. The pressure load is transferred to gasket portion 206 of the baffle, which is pressed by the loads into even closer and more effective contact with the seat. An integral formation of the gasket with the remainder of the baffle is generally preferred as the most convenient and sure means for providing a good seal, but the gasket may advantageously be provided as a separate part, or omitted altogether in some situations, particularly where relatively low test pressures are anticipated. Preferred embodiments of test baffle 200 further comprise a means for removal of the baffle from the water closet fitting and from the drain system when testing has been completed. The removal means may comprise a line or cord such as cord 208 attached to the baffle and operated by pulling to remove the baffle from the system or other portion of the conduit. The removal means, such as line or cord 208, may extend from the baffle through the drainage system to an exit port or to a point located near an access or cleanout port such as port 57 shown in FIG. 2. Alternatively, a hook or other tool such as tool 209 may be used to engage the baffle through an adjacent cleanout port, as shown in FIG. 2. Means such as removal lug 202 are preferably provided on the baffle for engagement of the removal means. A lug is particularly well adapted for use with either a cord or hook. Thus by activating the removal means the flexible baffle may then be removed from the drain system by way of the drain system, leaving behind no permanent structure or other material or portion of the baffle to obstruct or interfere with flow within the drain. An optional means for removably attaching the test baffle to the water closet fitting comprises integral formation of the test baffle with the first end of the fitting and provision of the test baffle at its junction with the fitting with a score line adjacent to said its seat in the first end, and a means for removing the test baffle by breaching the seal along the score line holding the baffle to the fitting. An optional retaining or storage means for restraining the removal means is shown in FIG. 3. Test baffle 200 comprises removable storage or retaining means 301, which is shown in the form of a membrane attached to the inner circumference of the baffle 200, in such manner as to trap line or cord 208 or other removal means within (in the embodiment shown) dome 300. The retaining or storage means facilitates storage, transportation, handling, and installation of the test baffle, without the removal means becoming fouled or otherwise proving troublesome. Once the test baffle has been installed, the storage or retaining means may be removed, as for example by puncturing membrane 310 with a screwdriver or other tool, or by use of an optional removal tab 311. Removal is further facilitated by providing a membrane, in embodiments which use membranes, with a score line or other means for making the membrane frangible proximate inner circumference 312 of the baffle. In embodiments inwhich a membrane is used, the membrane may be solid (as shown) or perforated, or in any other suitable configuration.

The water closet fitting, flange, and test baffle of the invention are preferably formed of plastic, metal, or any other substance having suitable strength, durability, fatigue resistance, damage tolerance, and corrosion resistance for the purposes indicated herein. Particularly preferred embodiments of the water closet fitting are made of polyvinyl chloride or other relatively strong, rigid, and impact- and corrosion resistant polymer; preferred flanges are of metal, so that the potentially relatively large loads induced in the flange by fasteners attaching the stool may be effectively supported. Preferred embodiments of the test baffle are made of flexible plastic or other suitably soft or flexible polymer, or of suitably hard rubber or other elastomer, so that when it is desired to remove the baffle it may be disengaged from the seat and removed from the system through flexure. Where present, optional retaining or storage means for retaining the removal means of the test baffle are made of materials similar to those used for the test baffle, or from cardboard, styrofoam, or any other suitable material.

Installation of a water closet stool at a selected rotational position with respect to the water closet fitting may be accomplished in any of several ways. For example, the flange may be set in a wet concrete floor in a predetermined position, so that upon setting of the concrete the flange is held in the desired position. Alternatively, the flange may be left sufficiently above the level of the floor when the floor is poured so that the flange remains above the floor when the floor is set, upon which the flange if made of a separate part may be freely rotated into any desired position. In such situations tightening of the fasteners connecting the stool to the flange pulls the upper ridge of the flange or water closet fitting snugly against the upper rim of the annular channel, holding the flange and stool in place as desired. Alternatively, the flange may be provided with elongated slots instead of standard holes, such that the stool fasteners may be freely located within the slot and the stool positioned accordingly.

In operation, the devices described above are first installed in a water closet as shown in the drawings. A water closet fitting comprising an emplaced test baffle and a flange is set in place and firmly attached to the drain system, with provision made for access to the removal means for the test baffle. A permanent floor is installed around the water closet fitting and optionally the drain system and allowed to set. The drain system is completed and all cleanout or access ports are closed, and the drain system is filled with water or otherwise pressurized. If the system is leak free, it is fully or partially drained, the test baffle is removed by means of a cord, hook, or other removal means or tool, and the drain system is connected to the downstream drain system outside the building or water closet. If desired, the test baffle may be installed in the sense opposite that shown in FIG. 1, such that the convex side of the dome is oriented toward the second end of the fitting, and the water closet fitting itself may be tested.

With regard to systems and components above referred to, but not otherwise specified or described in detail herein, the workings and specifications of such systems and components and the manner in which they may be made or assembled or used, both cooperatively with each other and with the other elements of the invention described herein to effect the purposes herein disclosed, are all believed to be well within the knowledge of those skilled in the art. No concerted attempt to repeat here what is generally known to the artisan has therefore been made.

INDUSTRIAL APPLICABILITY

The invention finds applicability in the field of plumbing, particularly in the installation of water closet drain fittings in permanently set floors. The invention provides greatly improved means for the installation and testing of water closet drains and water closet stools in permanent installations.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

I claim:

1. A water closet fitting and test baffle assembly for installation within and pressure testing of a water closet drain system in a poured, permanently set floor, said assembly comprising:

a water closet fitting adapted to drain a water closet stool, the fitting comprising a first end, a second end, and an interior surface, the first end adapted for engagement of a drain system having an inside diameter and an interior surface and said first end comprising an adjacent interior seat circumferentially disposed into said interior surface of the fitting to receive a test baffle in a fluid tight sealing relationship, said seat having a diameter greater than an inside diameter of the fitting, said second end adapted to engage a flange;

said flange adapted to engage a water closet stool in a selectably permanent and/or releasable engagement; and said test baffle adapted to be received in said interior seat, the baffle comprising a convex central dome, having an unflexed diameter exceeding said inside diameter of said fitting, and being flexible, whereby said baffle may be flexed for removal from said fitting without leaving any portion of said baffle within said drain system, said convex central dome oriented such the dome tends to resist by means of internal compression pressure applied to said dome from said drain system; said test baffle further comprising means for removal of the baffle from the fitting and the drain system following testing of the drain system;

said seat and said test baffle comprising a dependent member and a receiving member, the dependent member adapted for interfering fit within the receiving member.

2. A water closet fitting and test baffle assembly for installation within and pressure testing of a water closet drain system in a poured, permanently set floor, said assembly comprising:

a water closet fitting adapted to drain a water closet stool, the fitting comprising a first end, a second end, and an interior surface, the first end adapted for engagement of a drain system having an inside diameter and an interior surface and said first end comprising an adjacent interior seat circumferentially disposed into said interior surface of the fitting to receive a test baffle in a fluid tight sealing relationship, said seat having a diameter greater than an inside diameter of the fitting, said second end adapted to engage a flange;

said flange adapted to engage a water closet stool in a selectably permanent and/or releasable engagement; and said test baffle adapted to be received in said interior seat, the baffle comprising a convex central dome, having an unflexed diameter exceeding said inside diameter of said fitting, and being flexible, whereby said baffle may be flexed for removal from said fitting without leaving any portion of said baffle within said drain system, said convex central dome oriented such the dome tends to resist by means of internal compression pressure applied to said dome from said drain system.

3. The assembly of claim 2, said test baffle further comprising means for removal of the baffle from the fitting and the drain system following testing of the drain system.

4. The assembly of claim 2, wherein said seat and said test baffle comprise means for releasable interengagement of the baffle by the seat.

5. The assembly of claim 4, wherein said means for releasable engagement comprises a dependent member and a receiving member, the dependent member adapted for interfering fit within the receiving member.

6. The assembly of claim 2, wherein an inner circumferential surface of said flange is adapted for rotatable engagement of an outer circumferential surface of said second end, whereby the flange may be selectably positioned to engage a water closet stool in a desired rotational orientation relative to said fitting.

7. A water closet fitting with test baffle appartatus comprising:

a water closet fitting comprising a first end, a second end, and an interior surface, the first end adapted for engagement of a drain system having an inside diameter and an interior surface and said first end comprising an adjacent interior seat circumferentially disposed into said interior surface of the fitting to receive a test baffle in a fluid tight sealing relationship, said seat having a diameter greater than an inside diameter of the fitting, said second end adapted to engage a flange;

said flange adapted to engage a water closet stool in a selectably permanent and/or releaseable engagement; and said test baffle adapted to be received in said interior seat, the baffle comprising a convex central dome, having an unflexed diameter exceeding said inside diameter of said fitting, and being flexible, whereby said baffle may be flexed for removal from said fitting without leaving any portion of said baffle within said drain system.

8. The apparatus of claim 7, said test baffle further comprising means for removal of the baffle from the fitting and the drain system following testing of the drain system.

9. The apparatus of claim 7, wherein said seat and said test baffle comprise means for releasable interengagement of the baffle by the seat.

10. The apparatus of claim 9, wherein said means for releasable engagement comprises a dependent member and a receiving member, the dependent member adapted for interfering fit within the receiving member.

11. The apparatus of claim 7, wherein an inner circumferential surface of said flange is adapted for rotatable engagement of an outer circumferential surface of said second end, whereby the flange may be selectably positioned to engage a water closet stool in a desired rotational orientation relative to said fitting.

* * * * *